US009895036B2

(12) United States Patent
Edwards et al.

(10) Patent No.: US 9,895,036 B2
(45) Date of Patent: Feb. 20, 2018

(54) ADJUSTABLE TOILET FOOTREST AND METHOD OF USE

(71) Applicants: Robert W. Edwards, St. George, UT (US); Judy M. Edwards, St. George, UT (US)

(72) Inventors: Robert W. Edwards, St. George, UT (US); Judy M. Edwards, St. George, UT (US)

(73) Assignee: Squatty Potty, LLC, St. George, UT (US)

( * ) Notice: Subject to any disclaimer, the term of this patent is extended or adjusted under 35 U.S.C. 154(b) by 17 days.

(21) Appl. No.: 14/712,911

(22) Filed: May 15, 2015

(65) Prior Publication Data

US 2015/0327739 A1 Nov. 19, 2015

Related U.S. Application Data

(60) Provisional application No. 61/993,978, filed on May 15, 2014, provisional application No. 62/069,943, filed on Oct. 29, 2014.

(51) Int. Cl.

| | |
|---|---|
| ***A47K 17/02*** | (2006.01) |
| ***A47C 9/10*** | (2006.01) |
| ***A47C 16/02*** | (2006.01) |
| *A47K 17/00* | (2006.01) |

(52) U.S. Cl.

CPC ..... *A47K 17/02* (2013.01); *A47C 9/105* (2013.01); *A47C 16/025* (2013.01); *A47K 17/028* (2013.01); *A47K 2017/006* (2013.01)

(58) Field of Classification Search

CPC ..... A47K 17/028; A47K 17/02; A47K 2017/006; A47K 11/04; A47C 9/00; A47C 9/002; A47C 9/025; A47C 9/04; A47C 9/10; A47C 9/105; A47C 16/02; A47C 16/025; A47C 16/04

USPC ..... 4/254; 108/138, 147.16; 297/423.39, 297/423.44, 423.46

See application file for complete search history.

(56) References Cited

U.S. PATENT DOCUMENTS

| | | | | | |
|---|---|---|---|---|---|
| 388,541 | A * | 8/1888 | Doll | A47K 11/02 | 4/254 |
| 1,798,632 | A * | 3/1931 | Romer | A47K 17/028 | 4/254 |
| 2,023,901 | A * | 12/1935 | Rhodes | A47K 17/028 | 4/254 |
| 2,113,882 | A * | 4/1938 | Galt | A47K 17/026 | 297/411.2 |
| D140,217 | S * | 1/1945 | Skolnik | 297/187 | |
| 2,834,028 | A * | 5/1958 | Stanley | A47K 13/06 | 297/423.1 |
| 2,912,046 | A * | 11/1959 | Fuerst | A47C 16/025 | 248/397 |
| 4,433,870 | A * | 2/1984 | Bairen | A47C 9/10 | 248/188.5 |

(Continued)

*Primary Examiner* — J. Casimer Jacyna
(74) *Attorney, Agent, or Firm* — Gallian, Welker & Beckstrom; Robert A. Gurr

(57) ABSTRACT

The present disclosure is directed to adjustable toilet footrests while using a toilet. In one embodiment, an adjustable toilet footrest comprises a foot platform having at least two telescopic legs extending therefrom, wherein the telescopic legs have a locking mechanism that allows for the height of the platform to be selectively adjusted to a user's desire.

2 Claims, 8 Drawing Sheets

(56) References Cited

U.S. PATENT DOCUMENTS

| | | | | |
|---|---|---|---|---|
| 5,577,806 | A * | 11/1996 | Ugalde | A47C 16/025 108/5 |
| 7,594,475 | B1 * | 9/2009 | Huang | A47B 9/16 108/10 |
| 8,414,079 | B1 * | 4/2013 | Zenoff | A47C 16/025 297/423.39 |
| 2006/0150315 | A1 * | 7/2006 | Sumpton | A47K 17/028 4/621 |
| 2009/0145340 | A1 * | 6/2009 | Parvizian | A47C 16/02 108/137 |
| 2013/0058707 | A1 * | 3/2013 | Wang | F16B 12/12 403/205 |
| 2013/0318698 | A1 * | 12/2013 | Schilpp | A47K 17/02 4/254 |
| 2014/0123376 | A1 * | 5/2014 | Edwards | A47K 17/028 4/254 |
| 2015/0141222 | A1 * | 5/2015 | DeLaCruz | A47C 9/002 482/142 |

* cited by examiner

ADJUSTABLE TOILET FOOTREST AND METHOD OF USE

CROSS-REFERENCE TO RELATED APPLICATIONS

This application claims the benefit of U.S. Provisional Application Ser. No. 61/993,978, filed on May 15, 2014, and U.S. Provisional Application Ser. No. 62/069,943, filed on Oct. 29, 2014, both of which are incorporated herein by reference.

TECHNICAL FIELD

The present disclosure relates to footrests. More specifically, the present disclosure relates to adjustable toilet footrests for use while on a toilet.

BACKGROUND

Humans can perform defecation in different postures; the two most common are squatting or sitting positions. The squatting posture is usually used when using a squat toilet (mainly a feature of the developing world), or when toilets are unavailable. The sitting posture during defecation is a standard posture seen in the western world because western-style toilets usually require a sitting position with the back erect and the knees away from the chest in about a ninety-degree angle.

The anorectal angle, which is the angle formed in the colon where the puborectalis muscle wraps around the rectum, is a very important factor in maintaining continence. The sitting posture common to western-style toilets causes a narrowing of the anorectal angle and prevents the puborectalis muscle from relaxing, which may cause difficulty in emptying the bowels.

Additionally, the sitting position may cause the person to repeat the Valsalva maneuver, i.e., exhalation against a closed airway to increase internal pressure, holding his breath to increase internal pressure, which can lead to syncope. A sitting posture may increase issues related to weakness in the colon wall because of the increased straining needed to defecate.

In contrast, the squatting defecation posture involves squatting by standing with the knees and hips sharply bent and the buttocks suspended near the ground. By using the squatting defecation posture, the anorectal angle is increased which allows the puborectalis muscle to fully relax which aids defecation by reducing the amount of effort needed to empty the bowels.

The advantages of the squatting position may be obtained when using western-style toilets (i.e., where the bowl is raised from the ground is intended for sitting as opposed to squatting) in conjunction with a footrest. Footrests help raise the knees toward the chest and help to lessen the normal sitting angle of about ninety-degrees to much less. As the feet are raised, the puborectalis muscle relaxes, the colon aligns allowing gravity to aid evacuation, and the required expulsive effort lessens. As such, several footrests exist in the art that are aimed at allowing a human to achieve a better anorectal angle while sitting on a toilet.

However, users come in a variety of sizes and shapes. Taller people need a different height than shorter people to achieve the desired anorectal angle. Further, many people need to adjust the height or angle of the toilet stool due to certain medical restrictions or conditions that may inhibit their ability to fully squat. As such, there remains a need for a toilet footrest that is easily adjustable to different heights and angles so as to accommodate users of all sizes and medical needs. The present invention seeks to solve these and other problems.

SUMMARY OF EXAMPLE EMBODIMENTS

The present disclosure is directed to adjustable toilet footrests while using a toilet. In one embodiment, an adjustable toilet footrest comprises a foot platform having at least two telescopic legs extending therefrom, wherein the telescopic legs have a locking mechanism that allows for the height of the platform to be selectively adjusted to a user's desire. One example of a locking mechanism may be a protrusion from the inner leg coupled to a coiled spring, such that the protrusion may be depressed, allowing for the outer leg to be slidable thereon so as to engage one or more extension apertures therein. The ends of the foot platform are of sufficient size to allow a foot to be comfortably rested thereon, while the inner portion is preferably concave and semi-circular so as to conform to the shape of a toilet.

In another embodiment, an adjustable toilet footrest may comprise a platform with at least two threadably adjustable legs extending therefrom. Each leg comprises a threaded inner rod and a threaded receiving shaft attached to the platform. This allows a user to adjust the height of the platform by twisting the inner threaded rod in relation to the threaded receiving shaft to achieve the desired height.

In another embodiment, an adjustable toilet footrest comprises a foot platform and sidewalls that have a plurality of apertures to adjust the height and angle of the foot platform.

DETAILED DESCRIPTION OF EXAMPLE EMBODIMENTS

Figure 1:
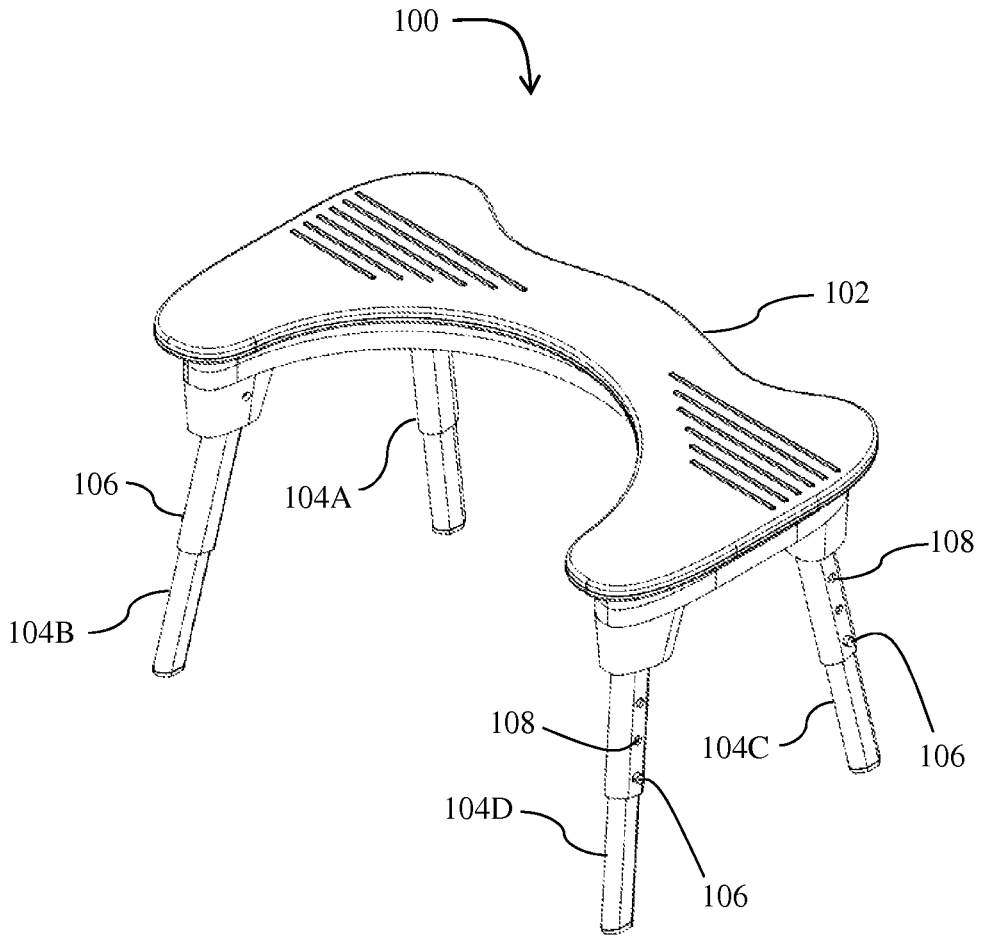
FIG. 1 is a back perspective view of an adjustable toilet footrest.

The following descriptions depict only example embodiments and are not to be considered limiting of its scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

As disclosed herein, an adjustable toilet footrest allows for adjustments of the height and angle of the foot platform in order to conform to a user's individual needs. An adjustable toilet footrest allows the user to obtain the correct anorectal angle to approximate a squatting position that cannot otherwise be obtained using a static or non-adjustable footrest. Users who are the same height may not require the same setting to obtain the correct anorectal angle through the footrest because one user's legs may be longer or shorter than the average user's legs. An adjustable toilet footrest allows the average user, as well as the non-average user, to obtain a better approximation of the squatting position and thus a better anorectal angle in order to defecate.

Further, the adjustable toilet footrest allows for users with uneven leg lengths due to genetic or environmental factors to make adjustments to the adjustable footrest to accommodate uneven height settings on either side of the footrest. Furthermore, the adjustable footrest allows for both a forward-tilting position as well as backward-tilting position. These settings may allow users to adjust for comfort as well as for either genetic or environmental factors, including, but not limited to, degenerative diseases, arthritis, surgeries, birth defects, and other such factors.

Referring now to what is generally illustrated in FIGS. 1-5, an adjustable toilet footrest 100 comprises a foot platform 102 and four legs 104A-104D extending downward from the foot platform 102. The legs 104A-104D are telescopic and have a locking mechanism that allows for the height of the foot platform 102 to be selectively adjusted to a user's desire. For example, telescopic legs 104A-104D may comprise a locking protrusion 106 for selectively engaging extension apertures 108. The locking protrusion 106 may be coupled to a coiled spring, such that the locking protrusion 106 may be depressed by a user, which then allows the user to slide the inner portion of the leg in relation to the outer portion of the leg until another extension aperture 108 is engaged, locking the moveable leg into position when the coiled spring forces the locking protrusion 106 through an extension aperture 108.

Figure 2:
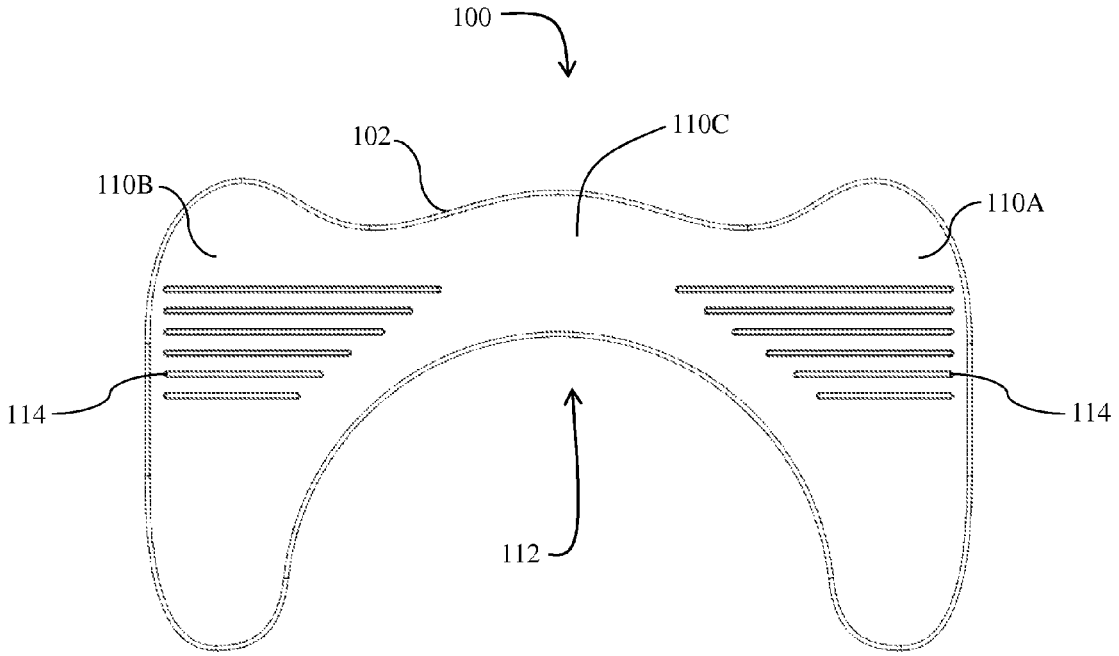
FIG. 2 is a top view of an adjustable toilet footrest.

FIG. 2 shows a top view of the adjustable toilet footrest 100. Foot platform 102 has sides 110A and 110B and a middle section 110C that forms a curvature 112, so as to allow the adjustable toilet footrest 100 to at least partially wrap-around a toilet. This allows the adjustable toilet footrest 100 to take up minimal space when not in use, while also allowing the user a variety of foot placements. However, it is important to note that other configurations may be suitable, such as rectangular, square, semi-circular, etc. As further shown, the foot platform 102 may further comprise a non-slip surface 114, which may cover the entire surface thereof or only a portion, such as on the sides 110A and 110B as shown. The right side 110A and left side 110B of the foot platform 102 are of sufficient size to allow accommodate a foot thereon, while the middle section 110C is preferably concave.

Further, unlike typical adjustable-height furniture, the present disclosure allows for the telescopic legs 104A-D to be adjusted independently, which allows for the foot platform 102 to rest at different angles. In other words, when using the adjustable toilet footrest 100, a user may find that an un-angled foot platform 102 creates undue tension or stress on the shins or other leg area. If desired, a user may lower the front two legs while leaving the back two legs un-adjusted. This creates a forward-tilting angle (angling downward, away from the toilet) on the foot platform 102 that may help relieve this stress. Likewise, a different user may desire an angle in the opposite direction, and may so adjust the back legs to a shorter position while the maintaining the front legs in an extended position, causing the foot platform 102 to angle backwards (downward toward the toilet). In an alternative embodiment, two of the legs may remain stationary (non-adjustable), while the opposite two are adjustable.

Figure 4A:
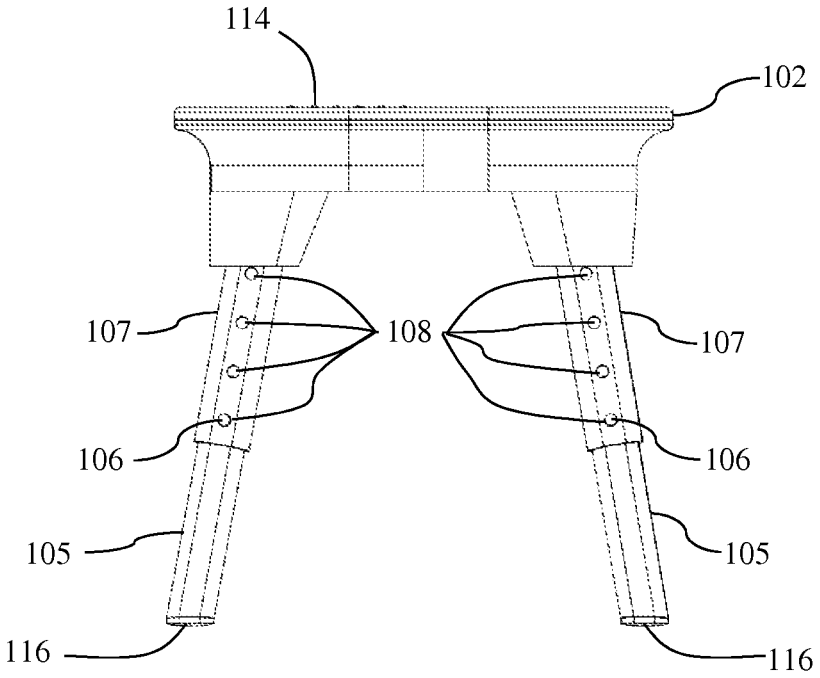
FIG. 4A is a side elevation view of an adjustable toilet footrest with the legs fully extended.
Figure 4B:
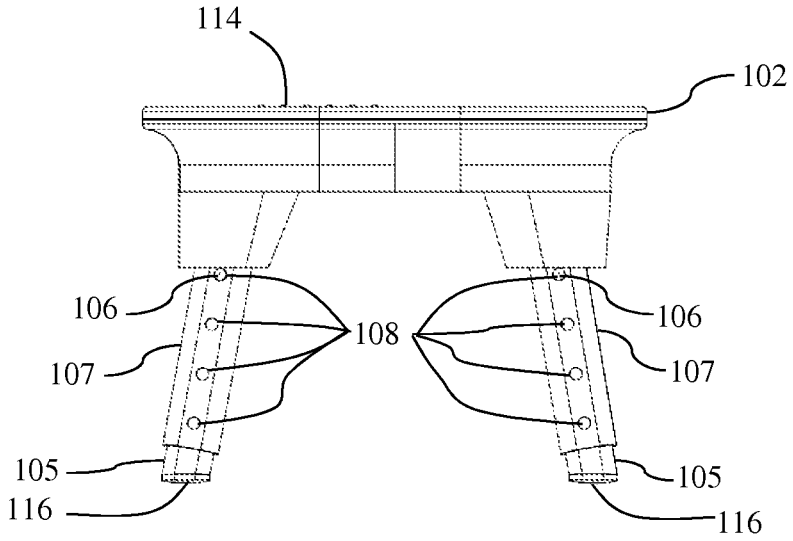
FIG. 4B is a side elevation view of an adjustable toilet footrest with the legs fully retracted.

As best seen in FIGS. 4A and 4B, each leg 104A-104D has multiple extension apertures 108, allowing users of different heights to likewise adjust the adjustable toilet footrest 100 to their desired height, as well as angle.

Figure 3:
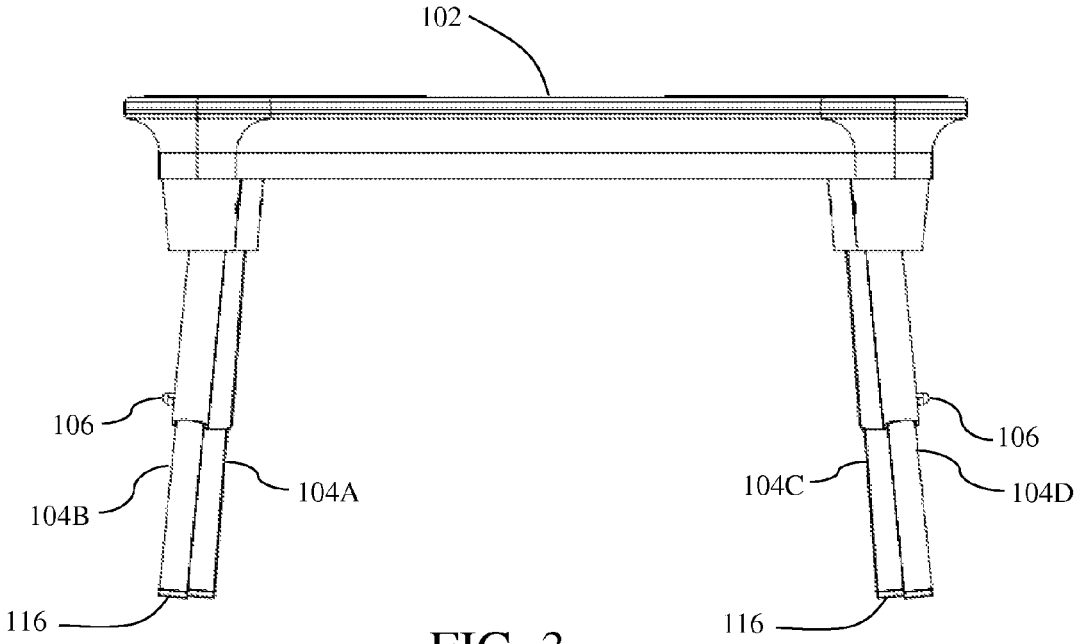
FIG. 3 is a back elevation view of an adjustable toilet footrest.

As best seen in FIGS. 3-4B, legs 104A-D may also have a non-slip surface on the leg feet 116. Further, FIGS. 4A and 4B illustrate the legs 104A-D (only two legs are visible in these views) being fully extended and fully retracted, respectively. In other words, each leg 104A-D may be comprised of an inner, moveable leg 105 and an outer receiving shaft 107. The outer receiving shaft 107 is coupled with or otherwise connected to the foot platform 102 so as to be immovable when in use; for example, screws may be used to secure the outer receiving shaft 107 to the foot platform 102. The outer receiving shaft 107 comprises one or more extension apertures 108 for engaging with locking protrusion 106. Locking protrusion 106 is operably connected to inner, moveable leg 105 such that it may be depressed by a user, allowing the inner, moveable leg 105 to slide within outer receiving shaft 107 until either fully collapsed, removed, or engaged with an extension aperture 108.

Figure 5:
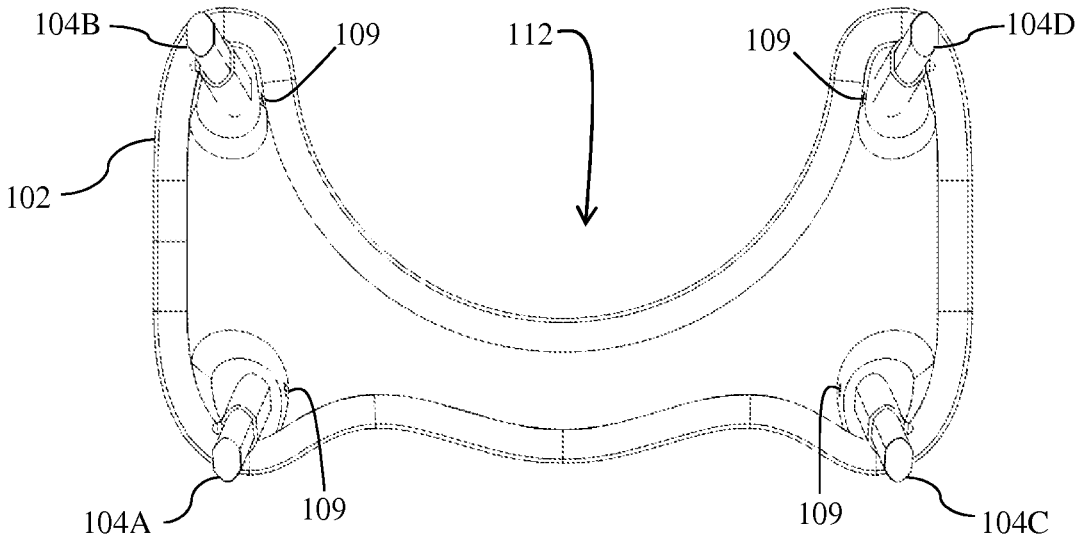
FIG. 5 is a bottom (underside) view of an adjustable toilet footrest.

FIG. 5 illustrates a bottom (underside) view of the adjustable toilet footrest 100. The legs 104A-D may be attached to the foot platform 102 in a variety of ways, such as screws, nails, or an equivalent through apertures 109, but may also be attached using glue, plastic weld, tongues and grooves, or may be integrated with the foot platform 102 itself. The foot platform 102 and legs 104A-D may also be made from a variety of rigid materials, including woods, plastics, high-density polyethylene, carbon fibers, and metals. The adjustable toilet footrest 100 is only meant to hold a person's resting legs, and therefore may be made from lightweight, yet rigid materials. The adjustable toilet footrest 100 is not meant to hold a person while standing, although it may with sufficiently strong and rigid materials.

In another embodiment (not shown), the legs of an adjustable toilet footrest may also be collapsible and/or removable for easy storage, transportation, and cleaning. For example, the legs may be hingedly attached, so as to allow them to pivot or collapse under the foot platform. When erect, the legs may be locked into position using locking poles that extend from the legs and that engage with accompanying apertures in the adjustable toilet footrest, may be spring loaded with locking pins, may use cotter pins, or any other equivalent leg locking means as those commonly associated with collapsible table legs.

In one embodiment (not shown), an adjustable footrest may comprise a platform with at least two threadably adjustable legs extending therefrom. Each leg comprises a threaded inner rod and a threaded receiving shaft attached to the platform. This allows a user to adjust the height of the platform by twisting the inner threaded rod in relation to the threaded receiving shaft to achieve the desired height. As with other embodiments discussed herein, each leg may be adjusted independently so as to allow a user to customize both height and angle of the platform.

Figure 6:
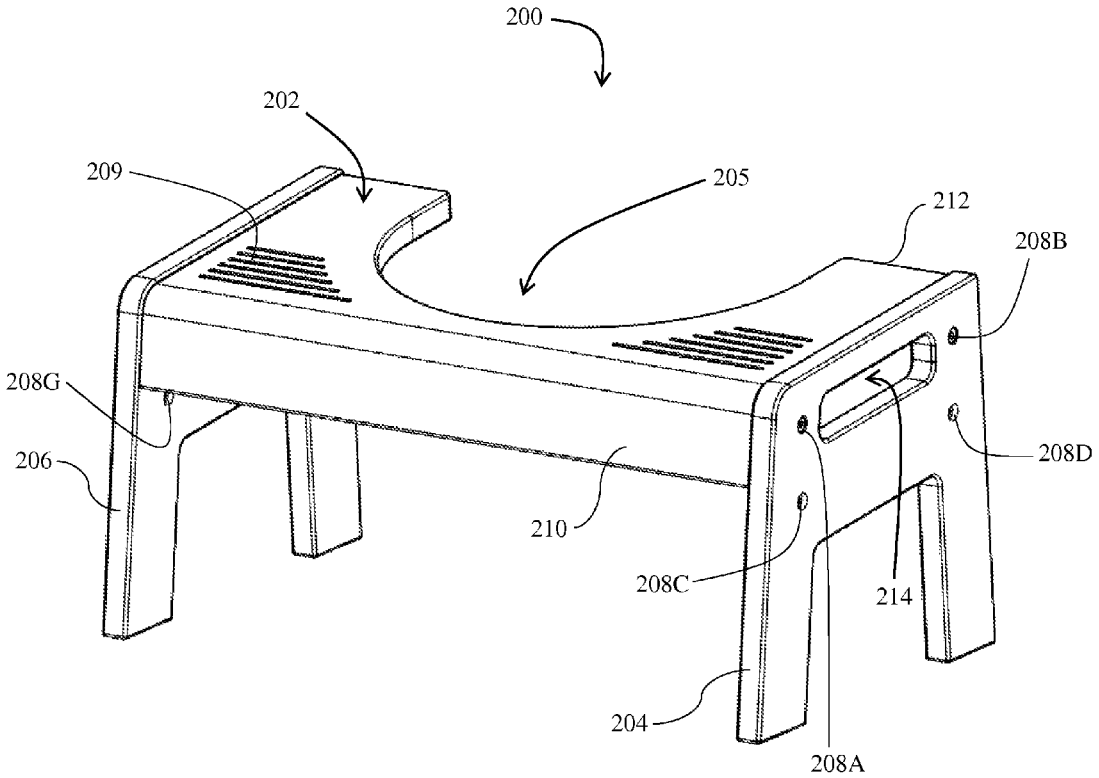
FIG. 6 is a front perspective view of an adjustable toilet footrest wherein the sidewalls are stationary.
Figure 7:
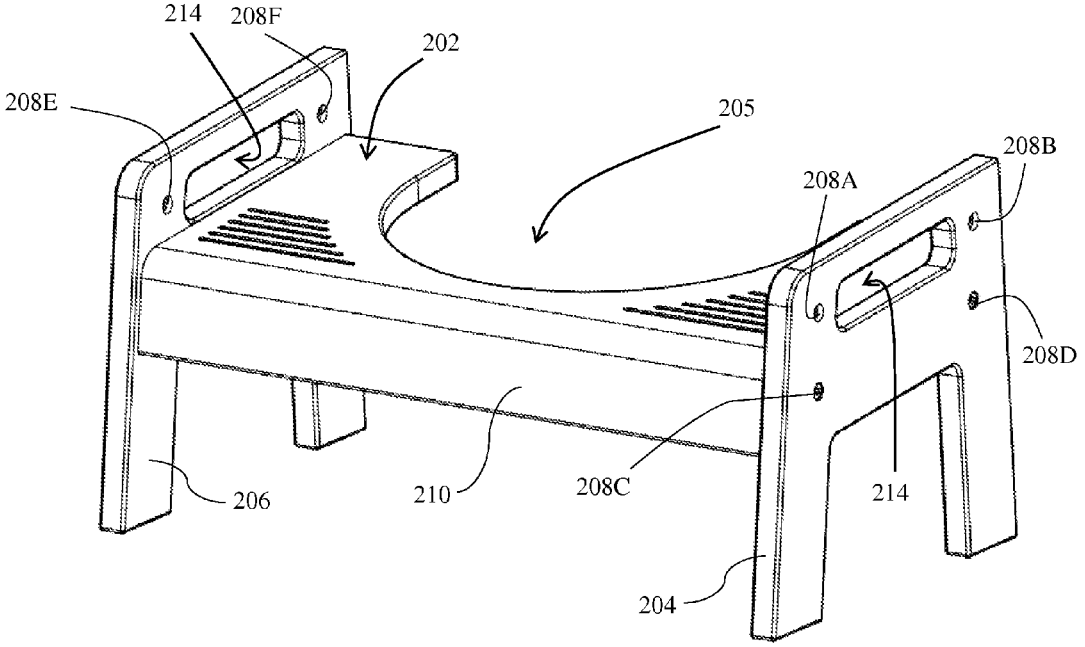
FIG. 7 is a front perspective view of an adjustable toilet footrest with the footrest platform in a lowered position.
Figure 8:
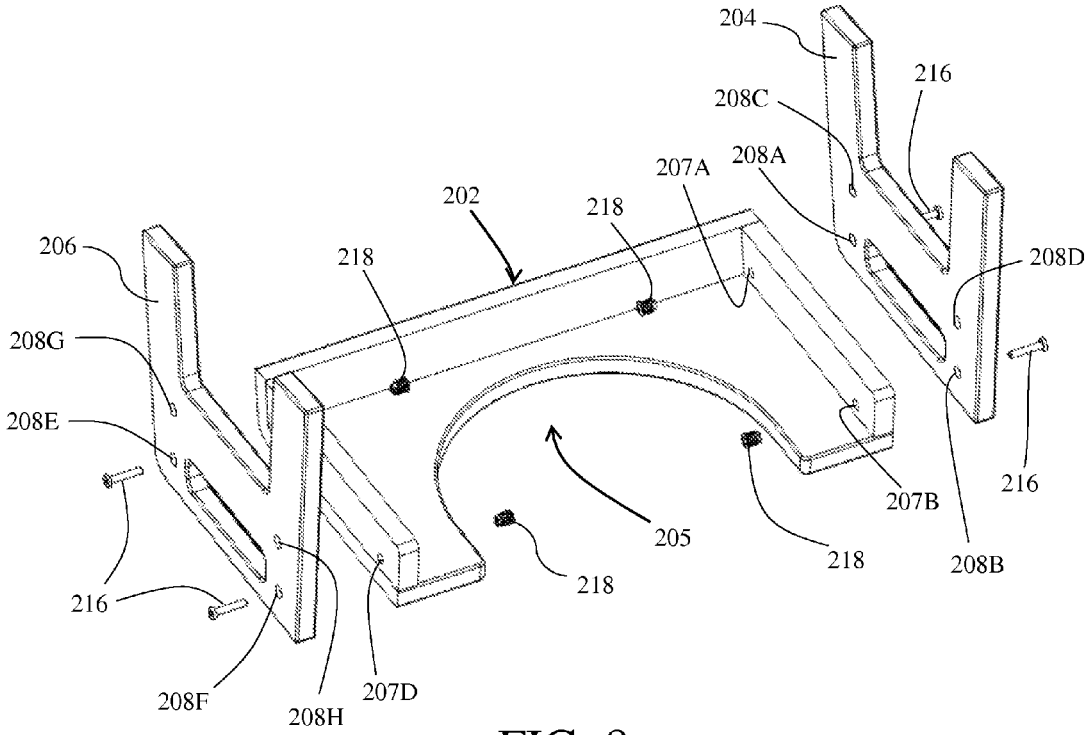
FIG. 8 is a bottom, exploded view of an adjustable toilet footrest and accompanying sidewalls.

In yet another embodiment, as generally illustrated in FIGS. 6-8, an adjustable toilet footrest 200 has a foot platform 202 coupled or otherwise connected to a left sidewall 204 and a right sidewall 206. Foot platform 202 preferably has a semi-circular curvature 205 for fitting around the base of a toilet and may also comprise a non-slip surface or surface portions 209. Semi-circular curvature 205 allows the adjustable toilet footrest 200 to take up minimal space while also allowing the user a variety of foot placements. However, other configurations may be suitable, such as rectangular, square, semi-ovular etc. Foot platform 202 connects to sidewalls 204, 206 on its ends via a connecting means, such as nuts and bolts, screws, or spring-loaded pins that pass through the sidewalls 204, 206 via a plurality of securing apertures 208A-208H (best seen in FIG. 8). Because quick and easy adjustment is intended, the connecting means preferably does not require tools. For example, elongated bolts with larger nuts for easy hand manipulation, or an equivalent, may be used. However, screws, hex keys, or equivalent connecting means may be used. The foot platform 202 may be placed in various positions, depending on which securing apertures 208A-208H are used. As shown in FIG. 6, the connecting means engage the foot platform 202 using securing apertures 208A, 208B on the left sidewall 204, and 208E and 208F on the right sidewall 206 (not visible in FIG. 6), which is referred to as the "high" position. Depending upon the construction of the sidewalls 204, 206, the high position may be angled or flat. The high position is ideal for children, shorter people, or those that are accustomed to squatting.

Although not illustrated, if a user desires to have a greater angle for the foot platform 202, the user may adjust the front portion 210 of the foot platform 202 to a "forward-tilting" position by engaging the lower securing apertures 208C and 208G. Likewise, a user desiring to have a "backward-tilting" foot platform 202 may leave the front portion 208A and 208C engaged and lower the rear portion 212 to engage securing apertures 208D and 208H. It will be understood that while eight securing apertures 208A-208H are shown, as few as six apertures may be used and many more than eight may be used.

Further, sidewalls 204, 206 may also have handles 214, which may be apertures meant for receiving a hand, or protrusions meant for lifting.

As shown in FIG. 7, the adjustable toilet footrest 200 has a foot platform 202 in the "low" position. For example, the foot platform 202 engages sidewalls 204, 206 through the lower set of securing apertures 208C, 208D, 208G, and 208H. Lowering the foot platform 202 allows a user with longer legs to maintain an ideal anorectal angle, and may also make it more comfortable for those not yet accustomed to the squatting position.

FIG. 8 shows an exploded bottom-view of the adjustable toilet footrest 200. As shown, foot platform 202 is attachable to the sidewalls 204, 206 by aligning platform apertures 207A-207D to the desired sidewall apertures 208A-208H. Once aligned, a securing means, such as bolts 216 pass through the aligned apertures and are secured in position using corresponding nuts 218. The adjustable toilet footrest 200 is therefore height-adjustable, angle-adjustable, and may also be completely disassembled for easy storage.

Although bolts and nuts are shown, other equivalent means known to those in the art may be used, such as screws, twist and lock mechanisms, cotter pins, spring-loaded pins, etc.

In another embodiment (not shown), the sidewalls may remain permanently attached to the foot platform, while still allowing the height adjustment. For example, tongues, grooves (channels), and apertures may be used that allow the foot platform to be easily adjusted. For example, a user could push in spring-loaded pins (i.e., the tongues) on the front sides of the foot platform, disengaging the spring-loaded pins from a first set of apertures, and slide the foot platform down the channels in the sidewalls to the lower position until the spring-loaded pins engage a lower set of apertures within the channels.

The adjustable toilet footrest may be made from a variety of materials, such as bamboo or other woods, rubbers, silicones, plastics, high-density polyethylene, carbon fibers, metals or other materials that allow for shape, durability, and strength.

As an example of use of the embodiments described herein, a user would first adjust the height and angle setting for the foot platform. The user would then place the adjustable toilet footrest at the front base of the toilet, so that, ideally, it wraps around the front of the toilet. While sitting on a toilet, a user will then raise their legs and place their feet on the foot platform, which creates the desired anorectal angle.

If the user is using a footrest with collapsible legs, the legs would first be locked into position before adjusting the height and before use. After use, the legs may be collapsed for easy storage.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. An adjustable height and angle toilet footrest, comprising:

a foot platform having a first side sized to receive a single foot of a user and a second side sized to receive a single foot of a user, and a middle section interposed between the first side and second side of the foot platform, the middle section having a cutout sized so as to at least partially fit around the base of a toilet;

the foot platform being interposed between a first sidewall and a second sidewall;

each sidewall comprising a top portion and a bottom portion, wherein the bottom portion comprises a front leg and a back leg, and the top portion comprises a cutout forming a handle which is interposed between a first set of sidewall apertures located on a front side of the top portion and above the front leg of the bottom portion, and a second set of sidewall apertures located on a back side of the top portion and above the back leg of the bottom portion;

the foot platform being selectively coupled to the first sidewall and the second sidewall by aligning a front platform aperture with one of the front sidewall apertures of the first sidewall, and a back platform aperture with one of the back sidewall apertures of the first sidewall, with a securing means received through the aligned apertures to secure the foot platform to the first sidewall; and, by aligning a front platform aperture with one of the front sidewall apertures of the second sidewall, and a back platform aperture with one of the back sidewall apertures of the second sidewall, with a securing means received through the aligned apertures to secure the foot platform to the second sidewall.

2. The adjustable height and angle toilet footrest of claim 1, wherein the securing means is a bolt.

* * * * *